US007717093B2

(12) United States Patent
Yamamoto et al.

(10) Patent No.: US 7,717,093 B2
(45) Date of Patent: May 18, 2010

(54) CANISTER ARRANGEMENT IN POWER GENERATING APPARATUS

(75) Inventors: Masanobu Yamamoto, Shizuoka-ken (JP); Takahide Sugiyama, Shizuoka-ken (JP)

(73) Assignee: Yamaha Motor Power Products Kabushiki Kaisha, Shizuoka (JP)

( * ) Notice: Subject to any disclaimer, the term of this patent is extended or adjusted under 35 U.S.C. 154(b) by 148 days.

(21) Appl. No.: 12/038,261

(22) Filed: Feb. 27, 2008

(65) Prior Publication Data

US 2008/0202480 A1 Aug. 28, 2008

(30) Foreign Application Priority Data

Feb. 27, 2007 (JP) ..... 2007-047481

(51) Int. Cl.
*F02M 33/02* (2006.01)
*F02M 33/04* (2006.01)

(52) U.S. Cl. ..... 123/519

(58) Field of Classification Search ..... 123/519, 123/518, 520, 516, 2, 572, 543; 181/204
See application file for complete search history.

(56) References Cited

U.S. PATENT DOCUMENTS 4,805,581 A * 2/1989 Yamada et al. ..... 123/519
5,054,453 A * 10/1991 Onufer ..... 123/516
5,687,697 A * 11/1997 Ishikawa ..... 123/520
6,792,897 B2 * 9/2004 Higuchi et al. ..... 123/2
7,114,492 B2 * 10/2006 Reddy ..... 123/518
2003/0070651 A1 * 4/2003 Higuchi et al. ..... 123/300
2007/0186910 A1 * 8/2007 Leone et al. ..... 123/520

FOREIGN PATENT DOCUMENTS

JP 07-034985 2/1995

OTHER PUBLICATIONS

U.S. App. No. 12/109,933, filed Apr. 25, 2008, Yamamoto, et al.
U.S. App. No. 12/110,014, filed Feb. 27, 2008, Yamamoto, et al.
U.S. App. No. 12/110,031, filed Apr. 25, 2008, Yamamoto, et al.

* cited by examiner

*Primary Examiner*—Mahmoud Gimie
(74) *Attorney, Agent, or Firm*—Keating & Bennett, LLP

(57) ABSTRACT

A power generating apparatus includes an engine for driving a generator; a fuel tank for storing fuel to be supplied to the engine therein, and a canister containing an adsorbent for adsorbing thereonto fuel that evaporates from the fuel tank to inhibit release of the fuel vapor into the atmosphere. The canister includes a communicating tube, which places the canister in communication with the atmosphere. The canister is in communication with an intake system of the engine. The canister is positioned proximate an exhaust system of the engine to improve the purge characteristics of the adsorbent so that a usable life of the adsorbent is increased.

18 Claims, 4 Drawing Sheets

CANISTER ARRANGEMENT IN POWER GENERATING APPARATUS

CROSS-REFERENCE TO RELATED APPLICATIONS

The present application is based on and claims priority under 35 U.S.C. 119 to Japanese Patent Application No. 2007-047481, filed on Feb. 27, 2007, the entire contents of which is hereby incorporated by reference and should be considered part of this specification.

BACKGROUND OF THE INVENTION

1. Field of the Invention

The present invention relates to a canister arrangement in a power generating apparatus and more particularly to an arrangement of a canister containing an adsorbent for adsorbing fuel that evaporates from an engine fuel tank.

2. Description of the Related Art

Japanese Publication No. JP 7-34985 describes a conventional device having a canister containing an evaporative fuel adsorbent. The device described in JP 7-34985 includes an engine, a fuel tank for storing fuel to be supplied to the engine, and a canister containing an adsorbent for adsorbing fuel that evaporates from the fuel tank. The canister includes a communicating tube, which places the canister in communication with the atmosphere. The canister is also in communication with an intake system of the engine.

The engine is driven by fuel supplied from the fuel tank and outputs a driving force of a predetermined magnitude. During this operation, the adsorbent and the canister containing the adsorbent therein generally work as follows. Fuel vapor is roughly constantly produced in the fuel tank. During a period in which the engine is stopped or in a low-speed range as in idling, most of the fuel vapor is adsorbed by the adsorbent, thereby preventing the fuel vapor from being released into the atmosphere.

When the engine is in a medium-speed or high-speed operating range, a negative pressure builds up inside the intake system of the engine. The negative pressure causes atmospheric air to be sucked into the canister through the communicating tube of the canister. The fuel vapor that has been adsorbed onto the adsorbent is purged from the adsorbent by said sucked air and flows along with the air into the intake system, where it is supplied to the engine and subjected to combustion.

When the adsorbent is left unused for a long period of time with the fuel vapor adsorbed thereonto, or when the fuel vapor is repeatedly adsorbed onto and purged from the adsorbent a number of times, the capability (e.g., usable life) of the adsorbent decreases, and a purge rate (purge characteristics) on the fuel vapor decreases.

SUMMARY OF THE INVENTION

In view of the circumstances noted above, one aspect of the present invention is to improve the purge characteristics of an adsorbent in a power generating apparatus that adsorbs fuel that evaporates from a fuel tank so as to prevent release of the fuel vapor into the atmosphere, thereby increasing a usable life of the adsorbent.

In accordance with one aspect of the present invention, a power generating apparatus is provided. The power generating apparatus comprises an engine comprising an intake system and an exhaust system, a generator driven at least in part by the engine, and a fuel tank configured to store fuel to be supplied to the engine. The power generating apparatus also comprises a canister containing an adsorbent material for adsorbing fuel that evaporates from the fuel tank, the canister comprising a communicating tube that communicates the canister with the atmosphere, the canister being in communication with the intake system, the canister being positioned proximate the exhaust system.

In accordance with another aspect of the present invention, a method of operating a power generating apparatus having a canister arrangement is provided. The method comprises adsorbing fuel vapor from a fuel tank with an adsorbent material to inhibit release of the fuel vapor into the atmosphere, suctioning air from the atmosphere into the adsorbent material to thereby purge said adsorbed fuel vapor from the adsorbent material, said suctioned air and purged fuel vapor directed to an intake system of an engine and combusted therein, and heating the adsorbent material so as to accelerate the purging of fuel vapor adsorbed on the adsorbent material, thereby increasing the adsorbing rate of the adsorbent material.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The drawings include the following 4 figures.

DETAILED DESCRIPTION OF THE PREFERRED EMBODIMENT

Figure 1:
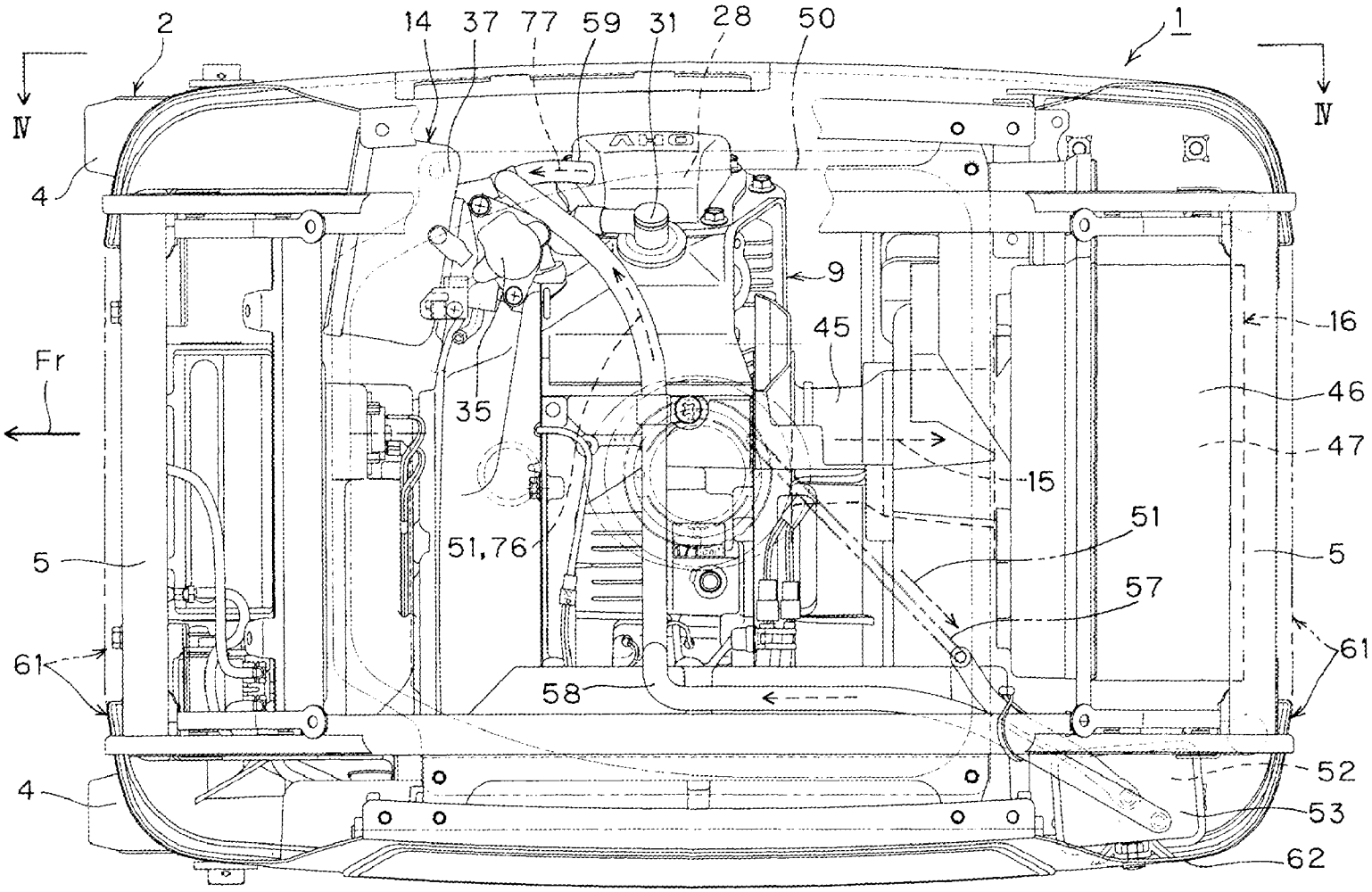
FIG. 1 is a schematic top plan view of one embodiment of a power generating apparatus.
Figure 2:
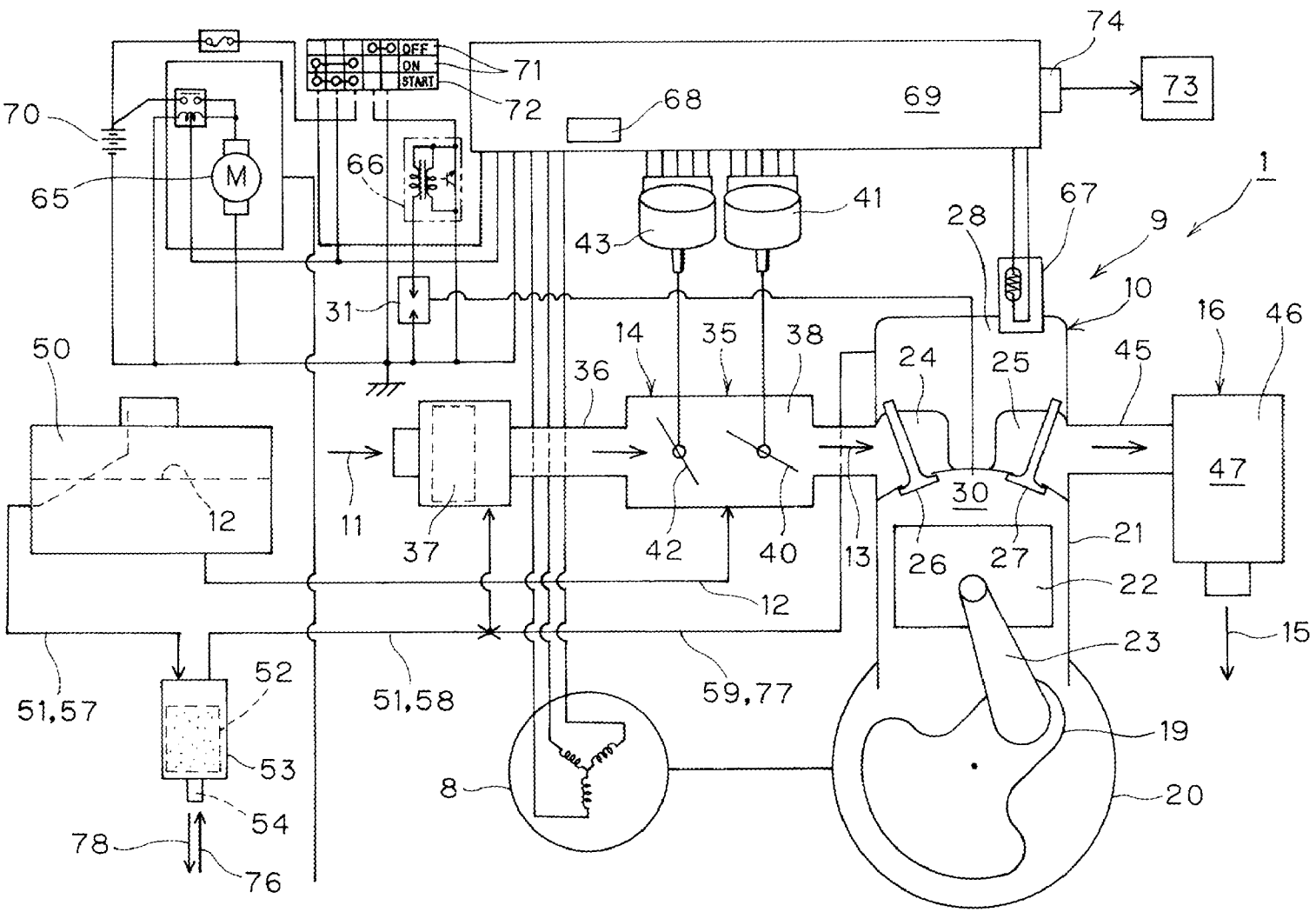
FIG. 2 is a block diagram of the power generating apparatus.

Reference numeral 1 in the drawings denotes a portable power generating apparatus. For clarity, in the following descriptions, a direction indicated by arrow Fr in the drawings is a forward direction of the apparatus 1.

The power generating apparatus 1 can be placed on a working surface such as the ground or a floor, and is provided with a cart 2 that allows the apparatus to move on the working surface. The cart 2 includes a chassis 3, front and rear wheels 4 supporting the chassis 3 on the working surface, and a pair of front and rear handles 5 supported by front and rear ends of the chassis 3, respectively.

An engine 9 for driving an alternating-current generator 8 can be mounted on the chassis 3. In one embodiment, the engine 9 is a four-cycle engine. However, the engine 9 can be other suitable engine-types. The engine 9 includes an engine body 10 that outputs a driving force, an intake system 14 for supplying an air-fuel mixture 13, which is a mixture of air 11 and fuel 12, to the engine body 10, and an exhaust system 16 for exhausting combustion gas, which is a resultant product of the combustion of the air-fuel mixture 13 in the engine body 10, to the atmosphere.

The engine body 10 includes a crankcase 20 supporting a crankshaft 19, a cylinder 21 in the crankcase 20 (e.g., in an upright orientation), a piston 22 axially slidably inserted into the cylinder 21, an interlocking rod 23 for interlocking between the crankshaft 19 and the piston 22, an intake valve 26 and an exhaust valve 27 for selectively closing and opening a first intake passage 24 and a first exhaust passage 25 formed in a projecting end of the cylinder 21, respectively, and a valve actuating mechanism (not shown) for selectively closing the intake and exhaust valves 26 and 27 housed in a valve actuating chamber 28 defined in the projecting end of the cylinder 21. The engine body 10 also includes a spark plug 31 with a discharging unit thereof facing a combustion chamber 30 inside the cylinder 21. Though the illustrated embodiment shows one cylinder 21 and the corresponding piston 22 and intake/exhaust valves 26, 27, one of ordinary skill in the art will recognize that the engine 9 can have multiple cylinders, each having a corresponding piston and intake/exhaust valves.

The intake system 14 can include a carburetor 35, an intake pipe 36, and an air cleaner 37, connected in series with the first intake passage 24. A space inside the carburetor 35, the intake pipe 36, and the air cleaner 37 is defined as a second intake passage 38, which is in communication with the first intake passage 24. The carburetor 35 can include a throttle valve 40 for adjusting an opening of the second intake passage 38, an actuator 41 (e.g., a step motor or other suitable motor type) for actuating the throttle valve 40, a choke valve 42 for adjusting an opening of the second intake passage 38 at a position upstream of the throttle valve 40, and an actuator 43 (e.g., a step motor or other suitable motor type) for actuating the choke valve 42.

The exhaust system 16 can include an exhaust pipe 45 and a muffler 46, connected in series with the first exhaust passage 25. A space inside the exhaust pipe 45 and the muffler 46 is defined as a second exhaust passage 47, which is in communication with the first exhaust passage 25.

A fuel tank 50 for storing fuel 12 to be supplied to the engine 9 through the carburetor 35 can be provided, for example, above the engine 9. An adsorbent 52 for adsorbing thereonto fuel vapor 51 originating from the fuel 12 in the fuel tank 50, and a canister 53 containing the adsorbent 52 therein are provided. In the illustrated embodiment, the adsorbent 52 is activated carbon. However, other suitable adsorbent materials can be used in other embodiments. The canister 53 can include, in its bottom, a communicating tube 54 which places the canister 53 in communication with the atmosphere.

A first communicating passage 57, through which an upper end of the fuel tank 50 is in communication with an upper end of the canister 53, is provided. A second communicating passage 58, through which the upper end of the canister 53 is in communication with the air cleaner 37 of the intake system 14, is also provided. A blow-by gas passage 59, through which the valve actuating chamber 28 is in communication with the air cleaner 37 of the intake system 14, is also provided. Each of the passages 57 to 59 can be formed of an elastic rubber hose. However, the passages 57-59 can be formed of other suitable materials, and need not all be of the same material.

A soundproof cover 61, which in one embodiment can be a resin cover, that releasably covers at least a portion of the generator 8, the engine 9, the fuel tank 50, the canister 53, and the passages 57 and 59 as a unit can be provided.

Figure 3:
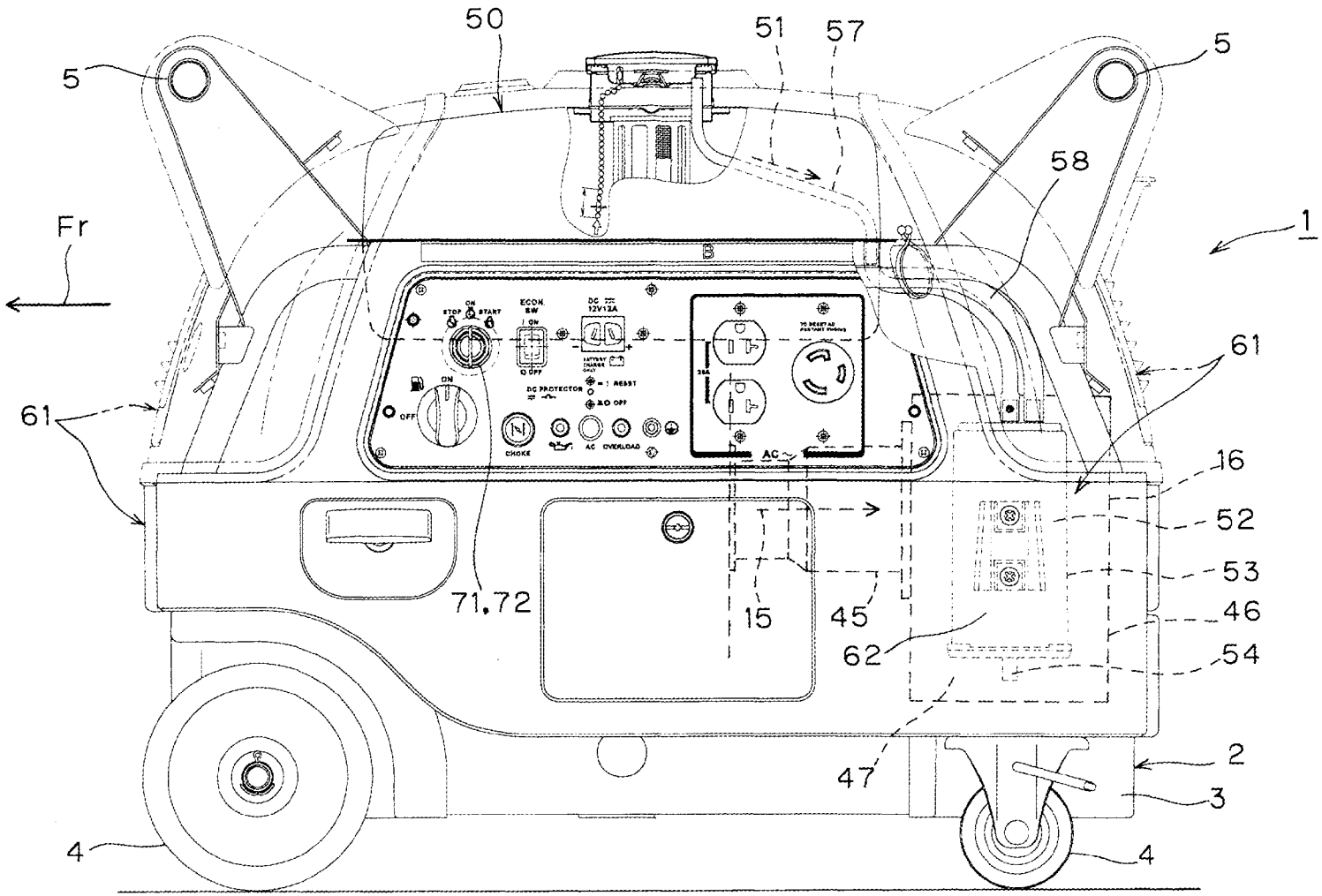
FIG. 3 is a schematic side view of the power generating apparatus.
Figure 4:
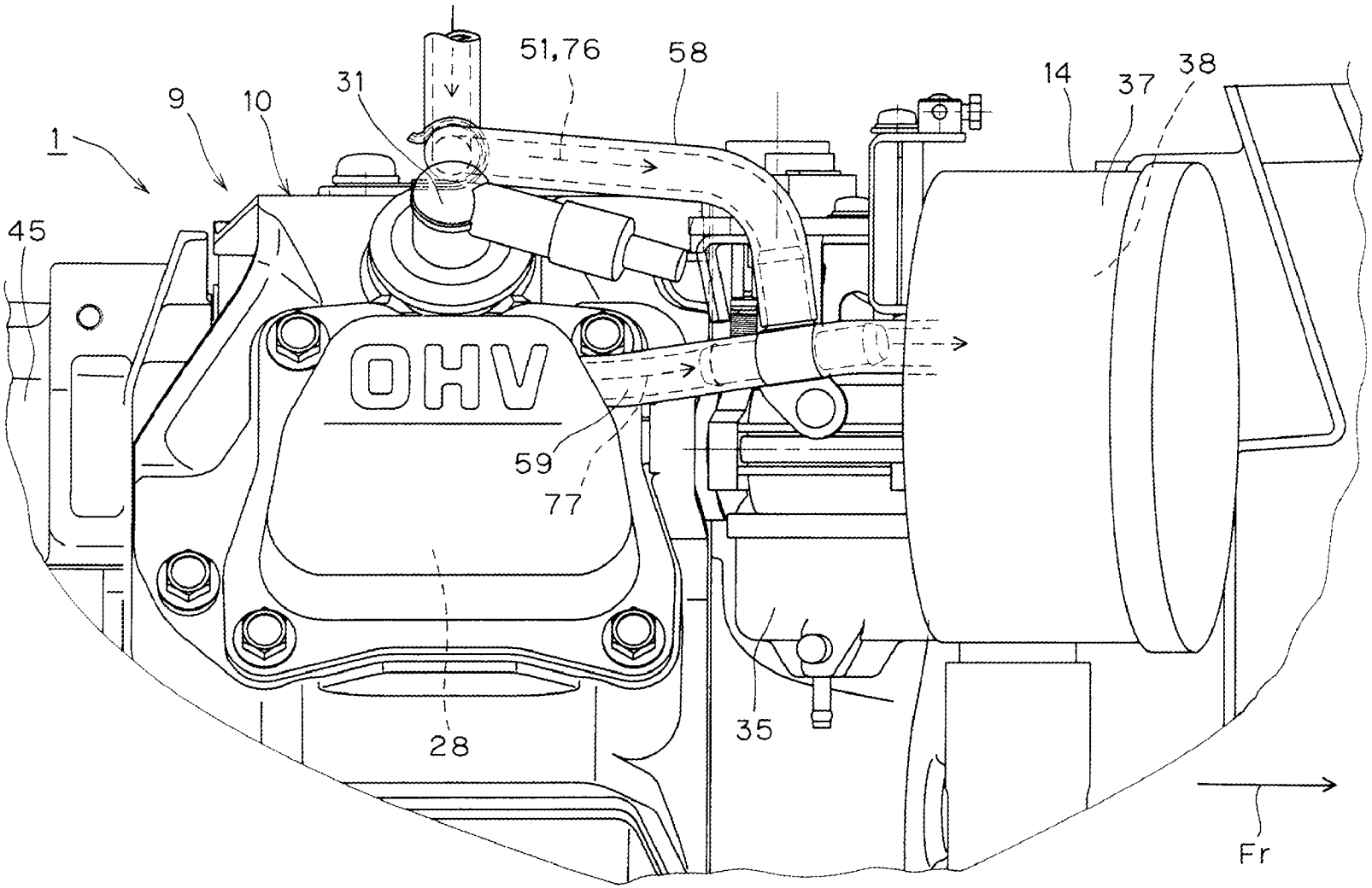
FIG. 4 is an enlarged schematic cross-sectional view taken along line IV-IV of FIG. 1.

In the illustrated embodiment, the canister 53 is positioned proximate and laterally spaced from the muffler 46 of the exhaust system 16. The canister 53 can be positioned near an inner surface of a portion 62 of the soundproof cover 61, as well as between the muffler 46 and the portion 62 of the soundproof cover 61. Referring to the side view (FIG. 3) of the power generating apparatus 1, in one embodiment the entire canister 53 can overlap with each of the muffler 46 and the portion 62 of the soundproof cover 61.

The power generating apparatus 1 can include a starter motor 65 for starting the engine 9, an ignition unit 66 for causing the spark plug 31 to electrically discharge as required, a temperature sensor 67 for detecting a temperature of the engine body 10, and an engine speed sensor 68 for detecting the number of revolutions of the crankshaft 19 in the engine body 10.

The power generating apparatus 1 can further include a controller 69, a battery 70, a main switch 71, and a starter switch 72. The controller 69 can electronically control the actuators 41, 43 and the ignition unit 66 based on detection signals supplied from the temperature sensor 67 and the engine speed sensor 68. The battery 70 can be charged with a portion of the electric power generated by the generator 8 through the controller 69, and can supply electric power to the actuators 41, 43, the ignition unit 66, and the like. The main switch 71 can switch on and off power supply from the battery 70 to the starter motor 65, the controller 69, and the like. The starter switch 72 can switch on and off power supply from the battery 70 to the starter motor 65 through the main switch 71. The controller 69 can include an outlet 74 through which the other portion of the electric power generated by the generator 8 can be output to an outside load 73.

When the engine 9 is driven under control of the controller 69, outside air 11 is sucked through the intake system 14 into the engine 9. The carburetor 35 mixes the fuel 12 with said sucked air 11 to produce the air-fuel mixture 13. The air-fuel mixture 13 is subjected to combustion in the engine 9. Through combustion, the engine 9 can drive the generator 8 to generate electric power, which can be output to the load 73 through the outlet 74. Combustion gas, which is a resultant product of the combustion in the engine 9, is released as exhaust 15 through the exhaust system 16 into the atmosphere.

During the above operation, the adsorbent 52 and the canister 53 work as follows. Fuel vapor 51 is roughly constantly produced in the fuel tank 51. When the engine 9 is stopped or in a low-speed range (e.g., idling), most of the fuel vapor 51 is adsorbed by the adsorbent 52 through the first communicating passage 57, thereby preventing the fuel vapor 51 from being released into the atmosphere.

When the engine 9 is in a medium-speed or high-speed range, a negative pressure builds up inside the intake system 14. The negative pressure causes air 76 to be sucked into the canister 53 from the outside through the communicating tube 54 of the canister 53. The fuel vapor 51 that has been adsorbed onto the adsorbent 52 material is purged from the adsorbent 52 by the sucked air 76 and flows along with the air 76 through the second communicating passage 58 into the air cleaner 37 of the intake system 14 and supplied to the engine 9 therefrom, where it is subjected to combustion.

During a period in which the engine 9 is driving, blow-by gas 77 generated in the valve actuating chamber 28 is sucked into the air cleaner 37 of the intake system 14 and supplied to the engine 9 therefrom, then subjected to combustion.

According to one embodiment, the canister 53 can be positioned proximate the exhaust system 16 of the engine 9.

Hence, when, in a state in which the engine 9 is stopped or in the low-speed range (e.g., idling) with the fuel vapor 51 adsorbed by the canister 53, the engine 9 is then shifted to the medium-speed or high-speed range, the muffler 46 of the exhaust system 16 is heated by the exhaust 15 from the engine 9 that passes through the muffler 46. Radiant heat liberated from the thus-heated muffler 46 heats the adsorbent 52 in the canister 53, which accelerates purging of the fuel vapor 51 adsorbed onto the adsorbent 52.

Accordingly, a purge rate of the fuel vapor 51 from the adsorbent 52 increases. That is, the purge characteristics of the adsorbent 52 are improved, which improves an adsorbing rate. Consequently, an increase of a usable life of the adsorbent 52 can be attained.

The improvement in the purge characteristics of the adsorbent 52 allows for the reduction of the amount of the adsorbent 52 used and the reduction in size of the canister 53. The smaller size of the canister 53 that can be achieved is significantly beneficial for the power generating apparatus 1, which has small surplus space due to a strong desire to reduce the size of the apparatus 1.

As described above, the soundproof cover 61 for releasably covering at least a portion of the generator 8, the engine 9, the fuel tank 50, and the canister 53 is provided. The canister 53 can be positioned near the inner surface of the portion 62 of the soundproof cover 61 as well as between the exhaust system 16 and the portion 62 of the soundproof cover 61.

Accordingly, the portion 62 of the soundproof cover 61 inhibits the radiant heat liberated from the exhaust system 16 toward the canister 53 from being wasted. As a result, the adsorbent 52 in the canister 53 is efficiently heated by the radiant heat, thereby further improving the purge characteristics thereof.

Meanwhile, the communicating tube 54 can be provided in the bottom of the canister 53.

The communicating tube 54 allows water 78 accumulated inside the canister 53 to be effectively drained out of the canister 53. As a result, the purge characteristics of the adsorbent 52 can be improved without being inhibited by the accumulation of the water 78.

In another embodiment, the canister 53 can be positioned proximate the exhaust pipe 45 of the exhaust system 16.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above.

What is claimed is:

1. A power generating apparatus, comprising:

an engine comprising an intake system and an exhaust system;

a generator arranged to be driven at least in part by the engine;

a fuel tank configured to store fuel to be supplied to the engine;

a canister containing an adsorbent material arranged to adsorb fuel that evaporates from the fuel tank, the canister comprising a communicating tube that communicates the canister with the atmosphere, the canister being in communication with the intake system, the canister being positioned proximate the exhaust system; and a soundproof cover arranged to removably cover at least a portion of the generator, the engine, the fuel tank, and the canister, the canister being positioned proximate an inner surface of a portion of the soundproof cover and disposed between the exhaust system and the portion of the soundproof cover.

2. The power generating apparatus of claim 1, wherein the communicating tube is disposed in a bottom of the canister.

3. The power generating apparatus of claim 1, wherein said communicating tube is configured to drain water that accumulates in the canister so as to improve a purging characteristic of the adsorbent.

4. The power generating apparatus of claim 1, wherein the adsorbent material comprises activated carbon.

5. The power generating apparatus of claim 1, wherein the exhaust system is configured to heat the adsorbent material in the canister.

6. The power generating apparatus of claim 4, wherein the exhaust system is configured to heat the adsorbent material in the canister via radiation heat transfer.

7. The power generating apparatus of claim 1, wherein the canister is laterally spaced from the exhaust system.

8. The power generating apparatus of claim 7, wherein the canister is laterally spaced from a muffler of the exhaust system, and the canister is disposed between the muffler and an inner surface of the soundproof cover.

9. The power generating apparatus of claim 1, wherein the canister overlaps with the exhaust system and the portion of the soundproof cover.

10. A method of operating a power generating apparatus including a canister, comprising:

adsorbing fuel vapor from a fuel tank with an adsorbent material to inhibit release of the fuel vapor into the atmosphere;

suctioning air from the atmosphere into the adsorbent material to thereby purge said adsorbed fuel vapor from the adsorbent material, said suctioned air and purged fuel vapor directed to an intake system of an engine and combusted therein; and heating the adsorbent material so as to accelerate the purging of fuel vapor adsorbed on the adsorbent material, thereby increasing the adsorbing rate of the adsorbent material the adsorbent material being disposed in the canister that is disposed between a muffler and an inner surface of a soundproof cover of the power generating apparatus, the soundproof cover enclosing the engine, the muffler, and the canister.

11. The method of claim 10, wherein heating comprises heating via radiation heat transfer.

12. The method of claim 10, wherein the adsorbent material comprises activated carbon.

13. The method of claim 10, further comprising draining water accumulated in the canister containing the adsorbent material so as to improve a purging characteristic of the adsorbent material.

14. The method of claim 10, wherein the canister is laterally spaced from the muffler.

15. A power generating apparatus, comprising:

an engine comprising an intake system and an exhaust system including a muffler;

a generator arranged to be driven at least in part by the engine;

a fuel tank configured to store fuel to be supplied to the engine;

a canister containing an adsorbent material arranged to adsorb fuel that evaporates from the fuel tank, the canister comprising a communicating tube arranged to communicate the canister with the atmosphere, the canister being in communication with the intake system, the canister being positioned proximate the muffler of the exhaust system; and a soundproof cover arranged to enclose the generator, the engine, the fuel tank, and the canister, the canister being positioned between the muffler and an inner surface of the soundproof cover.

16. The power generating apparatus of claim 15, wherein the canister is laterally spaced from the muffler, the canister is disposed between the muffler and the inner surface of the soundproof cover.

17. The power generating apparatus of claim 16, wherein the canister is laterally spaced from the muffler in a direction transverse to a longitudinal axis of the power generating apparatus.

18. The power generating apparatus of claim 15, wherein the canister overlaps with the muffler and a portion of the soundproof cover.

* * * * *